US005422798A

United States Patent [19]

Osiecki et al.

[11] Patent Number: 5,422,798

[45] Date of Patent: Jun. 6, 1995

[54] FLASHLIGHT SWITCH

[75] Inventors: Scott W. Osiecki; David A. Furth, both of Skaneateles; Stephen M. Hale, Baldwinsville, all of N.Y.; K. W. Au, Kowloon, Hong Kong

[73] Assignee: Eveready Battery Company, Inc., St. Louis, Mo.

[21] Appl. No.: 73,140

[22] Filed: Jun. 7, 1993

[51] Int. Cl.[6] ..... F21L 7/00

[52] U.S. Cl. ..... 322/206; 362/204

[58] Field of Search ..... 362/204, 205, 206, 208, 362/202, 394

[56] References Cited

U.S. PATENT DOCUMENTS

| | | | |
|---|---|---|---|
| 2,226,353 | 12/1940 | Wood | 362/204 |
| 2,503,287 | 4/1950 | Moore | 362/206 |
| 4,823,242 | 4/1989 | Maglica et al. | 362/206 |
| 4,890,203 | 12/1989 | Watson | 362/206 |
| 4,949,231 | 8/1990 | Wang | 362/206 |

FOREIGN PATENT DOCUMENTS

| | | | |
|---|---|---|---|
| 500288 | 3/1954 | Canada | 362/206 |

*Primary Examiner*—Ira S. Lazarus
*Assistant Examiner*—Alan B. Cariaso
*Attorney, Agent, or Firm*—Robert W. Welsh; Richard C. Cooper

[57] ABSTRACT

A switch for use in a flashlight assembly including a tubular body for containing or receiving a power source such as at least one battery. A light assembly including a light source coupled to one end of the body, and a switch assembly closing an opposite end of the body and moveable about a longitudinal axis of the body between at least a first position for placing the light source in electrical continuity with the power source and a second position breaking the electrical continuity between the light source and the power source. The switch includes a tubular housing detachably received in the opposite end of the body and having a detent extending inwardly from an inner surface thereof. The housing concentrically receives a neck portion of an end cap which closes the housing and forms one end of the flashlight. A pair of grooves, one on each side of a cantilevered spring in the neck portion, accepts the detent extending from the housing. The grooves and spring define first and second positions for the switch. The neck portion also contains a concentric hole which receives a contact assembly for making electrical continuity between the power source in the body and the open terminal of the light source. The contact assembly is retained within the neck portion, and the end cap is retained within the housing by a retaining member snapped into the concentric hole of the end cap neck. The retaining member includes a flange which prevents withdrawal of the end cap while permitting rotation between the first and second position.

19 Claims, 3 Drawing Sheets

FLASHLIGHT SWITCH

BACKGROUND OF THE INVENTION

This invention relates generally to electrical switches, and particularly to an electrical switch for use in flashlights.

In general, flashlights and portable lanterns include a protective body which contains one or more batteries electrically connected, either in series or in parallel by a conductor to a light source. The conductor is typically interrupted by one of three well-known switching mechanisms: a push button switch, a slide, or a twisting head which moves the light source into contact with the conductors.

Disadvantages associated with the push button and slide switches include the difficulty within which to aesthetically incorporate the switches within the design of the flashlight. A further problem associated with the push button switch is the occasional failure of the spring mechanism used to rebound the switch between the on/off positions. In addition, push button switches generally lack a wiping action to clear contact points of corrosion build-up, the result of which can be a loss of electrical continuity, and ultimately failure of the lighting product to function. A disadvantage associated with twisting the head into contact with the conductors is that the operator often does not know which way to rotate the head to turn on the flashlight. Due to the focus adjustment feature, which requires that the head assembly be rotated through various positions, switching within that same action becomes more difficult to achieve. For example, the ideal action for such an embodiment would be for the switch to be off when the head or lens housing is in its forward-most position. Some rotation, and resulting rearward longitudinal motion, would be required to make contact, and activate the light source. Contact could then be maintained during subsequent rotation and resulting longitudinal motion rearward as the focus is adjusted. The problem that occurs with this method is that the head must always be returned to its forward-most position to deactivate the light, and with every use, focus position must be adjusted. The user can never be sure he will be at the previously set focus, which may be perceived as an annoyance.

The purpose of the present invention is to provide a flashlight having a two-position switch which aesthetically blends with the exterior or ornamental design of the flashlight. It is a further purpose of this invention to provide a two-position switch for use in flashlights, having a positively locking first and second position, and to provide a corrosion-clearing wiping action between the mutually tangent surfaces of the contact strips.

SUMMARY OF THE INVENTION

One form of the invention is a flashlight which includes a body or housing for containing a power source therein. Fixed to the body is a light assembly having a light source with one terminal in electrical contact with one pole of the power source and a second ternfinal proximate the opposite pole of the power source. The body is closed by a switch assembly which includes a switch to selectively connect and disconnect the second terminal of the light source with the power source.

In a second form of the invention, the switch of the flashlight includes a housing which is detachably coupled to one end of the flashlight body and has a detent extending from an inner wall thereof. The housing concentrically receives a neck portion of an end cap closing one end of the housing. The neck portion of the end cap contains a pair of grooves separated by a cantilevered spring for receiving the detent extending inwardly from the housing to define at least a first and second position for the end cap. A hole in the neck portion concentric with the longitudinal axis of the end cap receives a contact assembly having a first portion for contacting the opposite pole of the power source and a second portion which selectively contacts the second terminal of the light source upon rotation of the end cap between the first and second position. The contact assembly is retained within the neck portion, and the end cap is retained within the housing, by a retaining member received in the hole in the neck portion. The retaining member permits manual movement of the end cap about its longitudinal axis to move the contact assembly in selective contact with the second terminal of the light source.

The advantages provided by each form of the invention include a more aesthetically appealing switch which is integral with the overall design of the flashlight. Secondly, the switch disposed within the end cap allows easy inspection of the critical contacts of the switch to make sure that electrical continuity is achieved. Additionally, as the on/off action requires that the contact strips pass one over the other in mutual tangency, a corrosion-reducing wiping action is automatically provided. The switch also has few parts for easy assembly without special tools. If necessary, the switch may be disassembled to effect repairs, or may be replaced in its entirety for little cost.

These and other objects, advantages, purposes and features of the invention will become apparent from a study of the following detailed description taken in conjunction with the appended drawing figures.

BRIEF DESCRIPTION OF THE DRAWING FIGURES

DETAILED DESCRIPTION OF THE PREFERRED EMBODIMENTS

Figure 1:
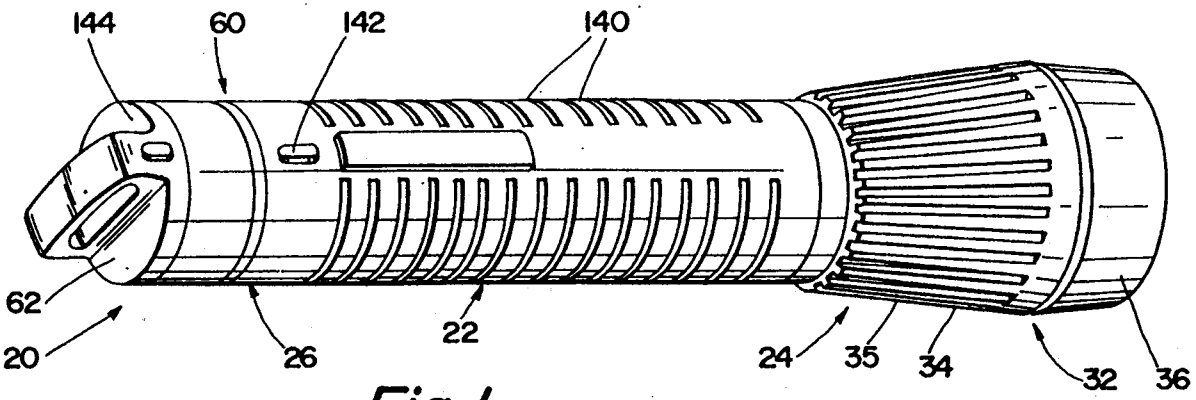
FIG. 1 is a oblique view of the flashlight embodying this invention.
Figure 2:
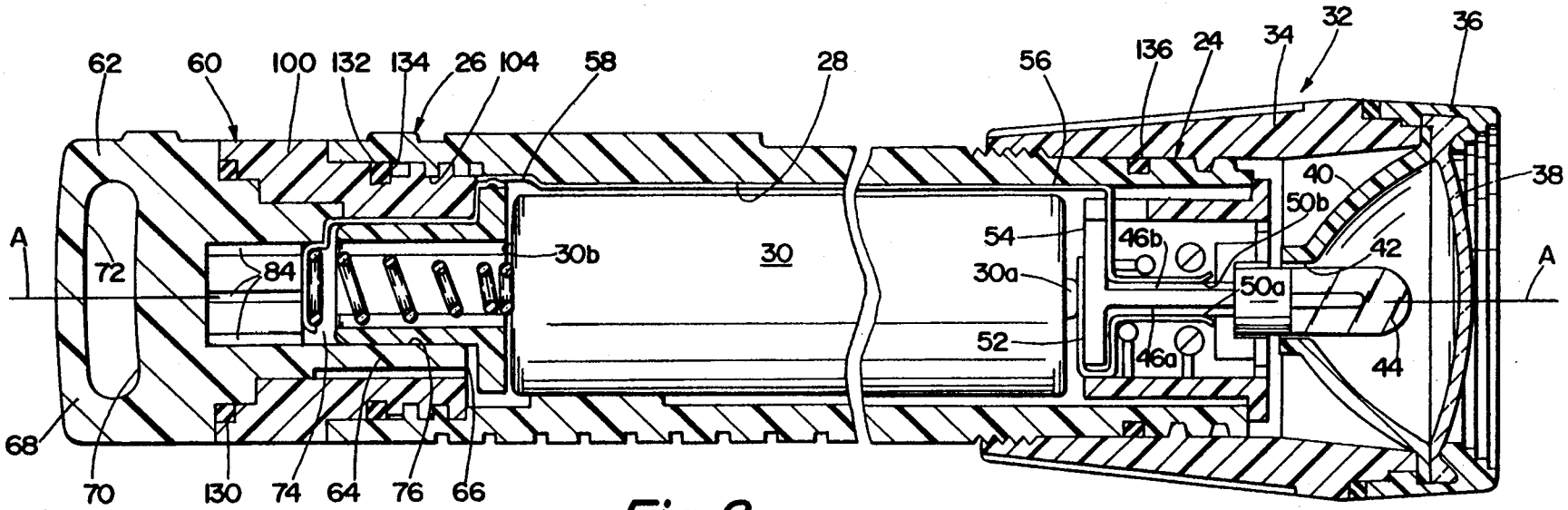
FIG. 2 is an elevational sectional view of the flashlight taken along lines II—II shown in FIG. 1.
Figure 5:
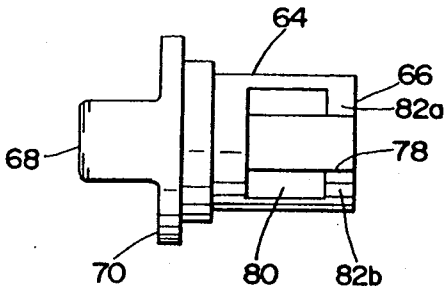
FIG. 5 is a bottom view of the end cap shown in FIG. 3.
Figure 4:
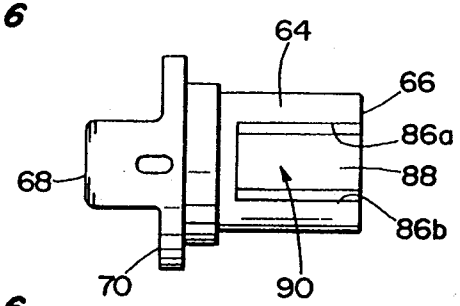
FIG. 4 is a top view of the end cap shown in FIG. 3.
Figure 3:
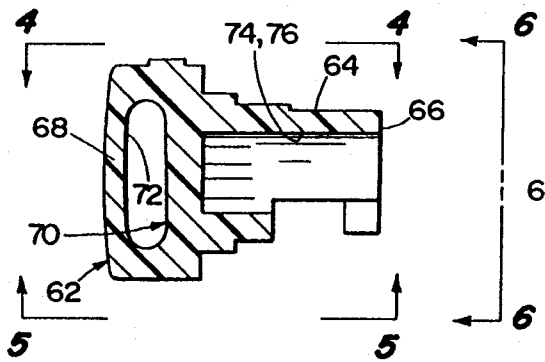
FIG. 3 is a sectional elevational view of an end cap used in the invention.
Figure 14:
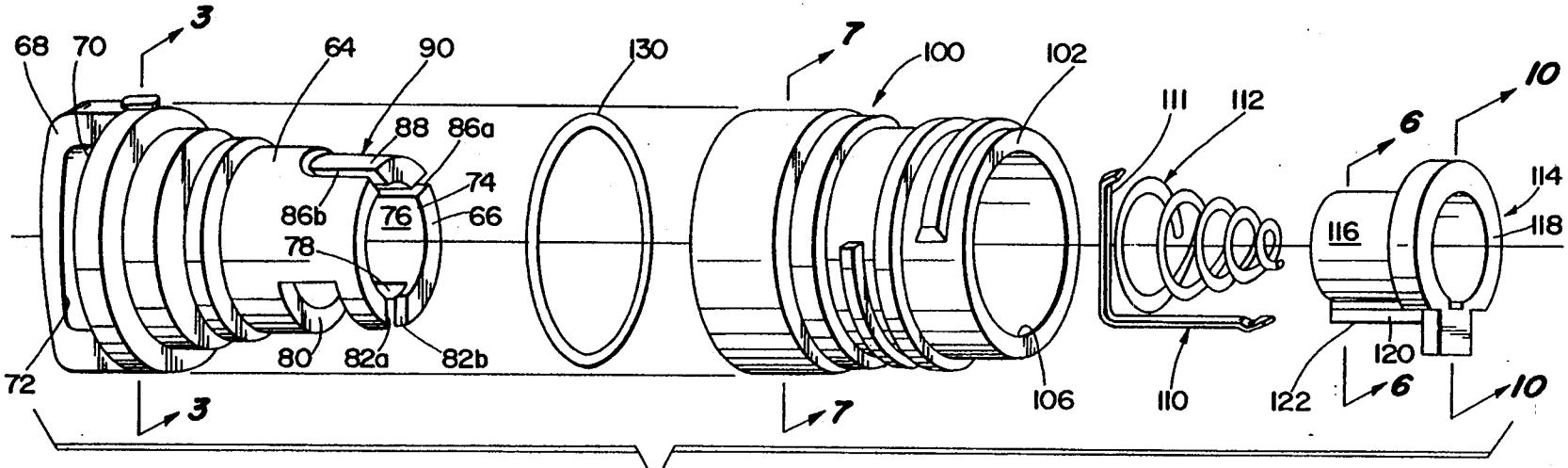
FIG. 14 is an exploded view illustrating the components comprising the switch assembly.
Figure 6:
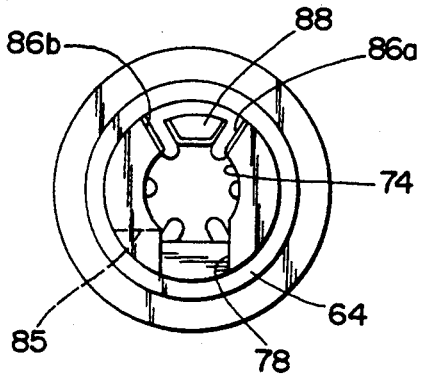
FIG. 6 is an end view of the end cap shown in FIG. 3.
Figure 7:
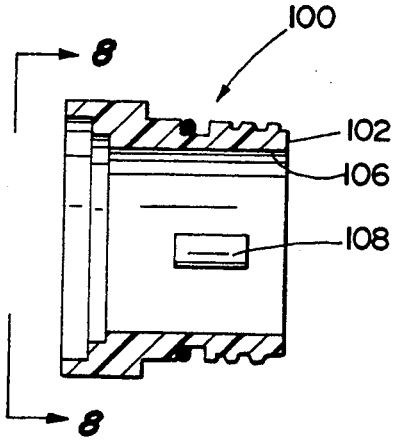
FIG. 7 is a sectional elevational view of a threaded housing.
Figure 8:
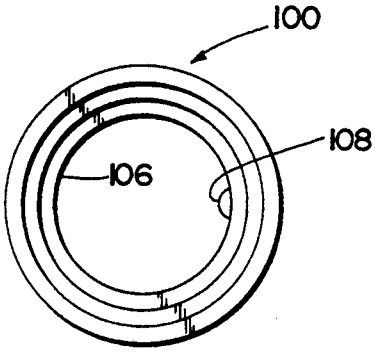
FIG. 8 is an end view of the housing shown in FIG. 7.
Figure 9:
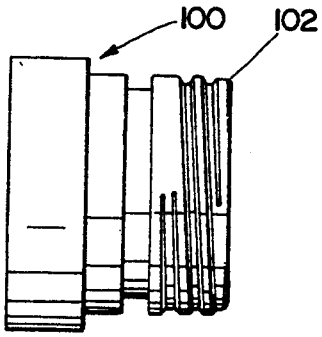
FIG. 9 is a side elevational view of the housing shown in FIGS. 7–8.
Figure 10:
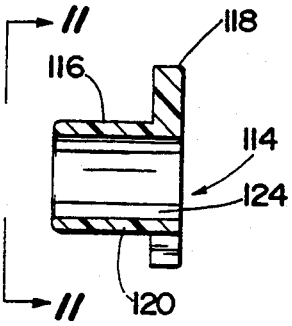
FIG. 10 is an elevational sectional view of a retaining cap and sleeve used in connection with the invention.
Figure 11:
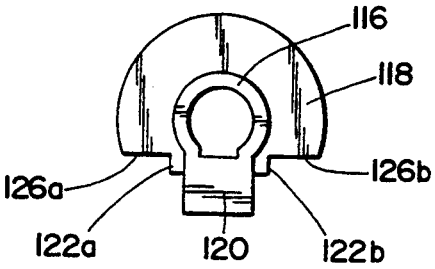
FIG. 11 is an end view of the retaining cap and sleeve shown in FIG. 9.
Figure 12:
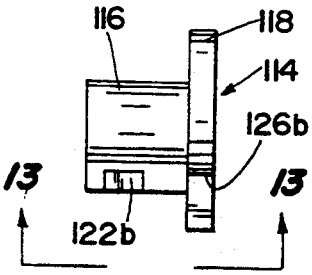
FIG. 12 is a side elevational view of the retaining cap and sleeve shown in FIG. 10.
Figure 13:
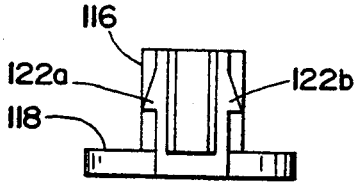
FIG. 13 is a top view of the retaining cap and sleeve shown in FIG. 10.

Referring to FIGS. 1 and 2, a first embodiment of flashlight 20 includes an elongate tubular body 22 having a first end 24 and a second end 26. In a preferred embodiment, tubular body 22 contains a longitudinal battery retention chamber which forms an inner wall 28 and extends from first end 24 along the length of body 22 and through to second end 26. The diameter of inner wall 28 is preferably dimensioned to accommodate one row of one or more dry cell batteries 30 which may have a size such as "D," "C," "AA" or "AAA" batteries. As in common practice, if more than one battery 30 is used, the batteries are of the same size and arranged in serial alignment with the positive pole 30*a* of one battery in contact with the negative pole 30*b* of the next battery.

Referring to FIG. 2, the first end 24 of tubular body 22 contains a light assembly 32. Assembly 32 includes a lens housing 34 which is threadably received along the first end 24 of tubular body 22. Lens housing 34 receives a lens bezel 36 which, in turn, retains a lens 38. Disposed between lens bezel 36, lens 38 and lens housing 34 is a reflector 40 having an opening 42 at its apex to receive a light source 44, such as a light bulb. Light assembly 32 can be longitudinally adjusted by twisting housing 34 along the threads to vary the position of light source 44 with respect to reflector 40 thus changing the focus and/or clarity of the light beam reflected from reflector 40.

Disposed behind reflector 40 in first end 24 of tubular body 22 is a lamp-retaining module 46 for retaining light source 44 having pins 46*a*, 46*b* received in sockets 50*a*, 50*b*. A first conductive contact strip 52 has one end disposed in socket 50*a* with an opposite end lying adjacent the interior end 54 of module 46 so as to contact one pole, preferably the positive pole 30*a* of battery 30 received in tubular body 22. A second conductive contact strip 56 has one end disposed in socket 50*b* and in contact with lamp pin 46*b*. Contact strip 56 preferably extends from module 46 and runs the length of tubular body 22 along wall 28 terminating at end 58 against the inner wall 28 proximate second end 26.

Closing the second end 26 of tubular body 22 is a switch assembly 60. Assembly 60 includes an end cap 62 having a cylindrical portion 64 (FIGS. 3–6) defining a first end 66 and a flange or projection 68 extending from the second end 70 of the end cap 62. Flange 68 extends across the diameter of end cap 62 and transversely to the longitudinal axis A of flashlight 20. It is preferred that flange 68 contain an opening 72 extending through it. Flange 68 provides a gripping point to turn switch assembly between a first "on" position and a second "off" position.

The cylindrical first end 64 of end cap 62 includes a concentric hole 74 which extends from the first end 66 to the main body of end cap 62 and defines an inner peripheral wall 76. A portion of wall 76 is removed to form a rectangular, radially and longitudinally extending opening 78 with the long axis of the opening oriented generally parallel to the longitudinal axis A of flashlight 20. Transverse to rectangular opening 78 is a second rectangular opening or slot 80 which defines tabs 82*a*, 82*b* at end 66 on opposite sides of opening 78. Extending inwardly into hole 74 from wall 76 between slot 80 and the main body of end cap 62 are ribs 84 to provide strength to cylindrical portion 64 as well as a seat for a conventional hydrogen absorbing or "better" material (not shown) such as platinum-plated, sintered aluminum.

In a preferred embodiment, opposite rectangular opening 78 and slot 80 in a portion of wall 76, are two longitudinal slots or grooves 86*a*, 86*b* on opposite sides of a cantilevered portion 88 of wall 76 to serve as a spring. The exterior surface 90 of cantilever spring 88 has a negative relief with respect to the exterior surface of cylindrical portion 64. This function of cantilever spring 88 will be readily apparent when described in greater detail below.

Concentrically receiving cylindrical portion 64 of end cap 62 is a threaded housing 100 having a first externally-threaded end 102 engaging internal threads 104 in the second end 26 of tubular body 22; see FIGS. 2, 7–9 and 14. The inside diameter of inner wall 106 is slightly greater than the outside diameter of cylindrical portion or neck 64 to act like a bearing surface and allow rotation of end cap 62 therein. A longitudinal, radially inwardly extending ridge or detent 108 extends from inner wall 106 and has a dimension appropriate to seat firmly within either longitudinal slot 86*a* or 86*b*, yet has a height slightly greater than the distance between inner peripheral wall 106 and the exterior surface 90 of cantilever spring 88. It is this structural relationship between slots 86*a*, 86*b*, cantilevered spring 88 and ridge or detent 108 which defines the first and second positions of switch assembly 60.

Disposed in concentric hole 74 and providing electrical continuity between the opposite pole of battery 30 disposed in tubular body 22 and end 58 of contact 56 is a rear contact 110 and a spring conductor 112. See FIGS. 2 and 14. Rear contact 110 is an L-shaped electrically conductive strip of material such as copper or similar conductive material which has a first transverse end 111 disposed diametrically across hole 74 and supported by ribs 83. Through a series of right angle bends, contact 110 extends from hole 74, and longitudinally through rectangular opening 78 formed in wall 76 to overlie a portion of inner wall 28 and selectively contact end 58 of contact strip 56 (FIG. 2). Spring conductor 112 is located with one end 113 urged against first end 111 of contact 110, and extends along longitudinal axis A of light 20 to engage the opposite pole of the one or more batteries 30.

End cap 62, contact 110 and spring 112 are held in place and within threaded housing 100 by a retaining member 114 (see FIGS. 2, and 10–14), which includes cylindrical sleeve portion 116 extending generally perpendicular from and concentric with a circular flange 118. Dependent from, and extending substantially the exterior length of sleeve 116 is a generally rectangular spline or key portion 120. The dimensions of sleeve portion 116 and dependent spline 120 are such so as to be received in a specific or "keyed" manner within concentric hole 74 in end cap 62. That is to say that sleeve portion 116 is adapted to be received by hole 74 in one way such that spline 120 is received by rectangular opening 78 formed in wall 76. Detents 122*a*, 122*b* formed along opposite sides of spline 120 slide past tabs 82*a*, 82*b* defined at the first end 66 of neck 64, and prevent withdrawal of sleeve 116. A concentric hole 124 extending the length of sleeve 116 allows spring 112 to extend therethrough while sleeve I 16 urges the bottom 113 of spring 112 against the first end of contact 110.

With sleeve 116 locked in hole 74 by detents 122a, 122b, circular flange 118 prevents withdrawal of neck 64 from threaded housing 100 because the diameter of flange 118 is greater than the outside diameter of neck 64 and abuts against the first end 102 of threaded housing 100. Segments of flange 118 are shown removed at 126a, 126b to provide access to tabs 82a, 82b after assembly so that switch assembly 60 may be disassembled for service as necessary. A tool may be inserted between spline 120 and each tab 82a, 82b to disengage detents 122a, 122b and allow withdrawal of retaining member 114.

To provide a substantially rugged flashlight capable of withstanding harsh treatment, it is preferred that substantially all components comprising flashlight 20 be molded from a high impact polymeric material such as XENOY® 5230 available from G.E. Plastics Co. of Pittsfield, Mass. Conductive elements such as contact strips 52, 56 and 110 are preferably made from copper while spring 112 is made from chrome-plated spring steel. It is also preferred that light source 44 include a bi-pin lamp capable of handling a voltage and amperage consistent with that provided by the batteries.

The interior of flashlight 20 can be made generally impervious to the invasion of water or water vapor by locating O-ring seals along each of the openings. For example, O-ring 130 is received about neck portion 64 proximate the main body of end cap 72 and adapted to seal with an inner wall of threaded housing 100. A second O-ring 132 is disposed in an annular groove 134 of threaded housing 100 and adapted to seal with an inner surface or wall of tubular body 22. In a similar fashion, O-ring seals such as 136 may be positioned to form seals between head assembly 50 and tubular body 22. With O-ring seals 130, 132 and 136 located as described above, flashlight 20 is waterproof to a depth of at least three feet of water or 1.1 atmospheres of pressure for at least 30 minutes.

Referring again to FIGS. 1 and 2, the exterior of tubular body 22 may be textured to form a slip-resistant surface and provide a good grip for the user. In a preferred embodiment, a series of concentric and equidistantly-spaced grooves 140 about the tubular body provide this function. In addition, the exterior of tubular body 22 contains an alignment mark 142 defined by a positive relief structure, which is aligned with a similar mark 144 formed at the end of flange 68 extending from end cap 62 to indicate when the switch is in the "on" position. FIGS. 1 and 2 also indicate that the exterior of lens housing 34 portion of light assembly 32 may be textured to form a slip-resistant surface and assist in rotating assembly 32 to achieve focus adjustment. In a preferred embodiment, a series of longitudinal and equidistantly spaced grooves 35 are formed about the housing to provide this function.

In operation, switch assembly 60 is removed from flashlight housing or casing 22 by turning end cap 62 about the longitudinal axis of the flashlight, to unthread switch assembly 60 from housing 22. The appropriate number of batteries are inserted into housing 22 through end 26 and switch assembly 60 closes end 26 by rotating end cap 62 in the opposite direction and engaging threads 104. Switch assembly 60 is threaded into housing 22 until end cap 62 is tight. Preferably, threads 104 and mutual threads within housing 22 are designed so that switch assembly 60 stops at a predetermined point. Such may be accomplished by designing a thread stop in the connection between such assemblies 60 and housing 22.

With the appropriate number of batteries disposed within flashlight 20 and switch assembly 60 closing the end of flashlight 20, the flashlight may be turned on or off by twisting end cap 62 between the first and second positions defined by the engagement of ridge 108 with detents or grooves 86a and 86b. The rotation of end cap 62 causes rear contact 110 to swing into contact with the end 58 of contact strip 56. Electrical current is then allowed to flow between the positive and negative contacts, 30a, 30b, through spring 112, rear contact 110, contact strip 56, and contact strip 52, with the rotation of end cap 62 swinging rear contact 110 into engagement with contact strip 56. The circular motion of the end of rear contact 110 engaging contact strip 56 creates a "wiping action" which reduces corrosion and clears the contact points and provides good electrical continuity therebetween. The flashlight may be turned off by rotating end cap 62 in an opposite direction to locate ridge 108 in the opposite detent slot 86a, 86b, and swing rear contact strip 110 away from contact strip 56, thus breaking electrical continuity between the poles of the batteries. The operator may determine whether or not the switch is in the "on" position by looking at the alignment of indicators 142, 144. It is preferred that the flashlight be in the "on" position with indicators 142, 144 positioned directly across from each other. By rotating end cap 62 to the "off" position, indicator 144 is moved with respect to indicator 142, causing the indicators to no longer be aligned with each other.

The preferred manner of inserting or removing batteries for flashlight 20 is by unscrewing switch assembly 60 from the rear 26 of housing 22. By unthreading switch assembly 60 from housing 22, the entire switch assembly 60 is removed intact and contained within thread housing 100. If for some reason switch assembly 60 were to malfunction or break down, switch assembly 60 may be replaced in its entirety without requiring to replace the entire flashlight. In addition, this invention provides that switch assembly 60 may be serviced by removing retaining sleeve 114 from the neck portion 64 of end cap 62. Removing of retaining sleeve 114 provides access to rear contact 110 and spring 112. Thus, according to this construction, any one of the malfunctioning parts may be replaced, or the entire assembly may be replaced as a whole.

Light assembly 32 at the opposite end 24 of flashlight 20 allows the operator to focus the beam of light reflected from reflector 40. By rotating lens housing 34 about the longitudinal axis A, the threads joining lens assembly 34 to body 22 move reflector 40 with respect to light source 44 and thus produce either a broad or narrow pattern of light reflected through lens 38. The advantage provided by this structure is that the operator may maintain a desired light beam configuration when turning on the flashlight.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A flashlight, comprising:

a flashlight body for receiving a power source therein;

a light assembly including a light source coupled to said flashlight body, said light source having one terminal positioned to be in electrical contact with one pole of said power source and a second terminal positioned to be proximate an opposite pole of said power source;

a switch assembly closing one end of said flashlight body, for selectively connecting and disconnecting said light source with said opposite pole of said power source, said switch assembly includes:

a threaded housing having a first end detachably received in said flashlight body and having a tubular wall extending the length thereof defining a longitudinal axis; and an end cap concentrically received in said tubular wall of said threaded housing and closing said flashlight body and said threaded housing, said end cap being rotatable with respect to said threaded housing about said longitudinal axis concentric with said threaded housing between a first position electrically connecting said light source and said power source, and a second position electrically disconnecting said light source and said power source.

2. The flashlight as defined in claim 1, wherein said switch assembly further includes:

a contact assembly disposed in said end cap for contacting said opposite end of said battery; and a retaining member disposed within said end cap for retaining said end cap within said housing.

3. The flashlight as defined in claim 2, further including a contact strip extending from said light assembly substantially the length of said housing and selectively in contact with said contact assembly disposed in said cap.

4. The flashlight as defined in claim 2, wherein said switch assembly further includes;

a cam extending from an inner surface of said housing;

a cam follower of predetermined length concentrically defined on an exterior surface of said end cap for following said cam; and a detent on said cam follower for engaging said cam and retaining said end cap in at least one of said first and second positions.

5. The flashlight as defined in claim 4, further including a projection extending from a second end of said end cap for manually rotating said end cap between said first and second positions.

6. The flashlight as defined in claim 4, further including:

a first seal disposed between said end cap and said housing; and a second seal disposed between said housing and said body.

7. A switch for selectively placing a light source in electrical communication with at least one battery disposed in a body, comprising:

a switch housing threadably coupled to said body and concentric therewith, and having a detent extending from an inner surface thereof;

an end cap having a neck portion concentrically received in said switch housing, said neck portion extending substantially through said switch housing along a longitudinal axis of said end cap and having a groove for receiving said detent to define at least a first and second rotational position of said end cap with respect to said switch housing about said longitudinal axis;

a contact assembly disposed in said neck portion of said end cap and having a first portion in electrical communication with the battery and a second portion forming a contact;

a retaining member received in said neck portion of said end cap for fixing said contact assembly therein and pivotally retaining said neck portion of said end cap within said housing; and said end cap being manually pivotal with respect to said switch housing about said longitudinal axis between said first and second rotational positions for selectively moving said contact into said electrical communication with the light source.

8. The switch as defined in claim 7, wherein said switch housing has a longitudinal axis coincident with the body and said end cap is pivotal about said longitudinal axis.

9. The switch as defined in claim 8, wherein said end cap further includes:

a cantilever defined in said neck portion and extending parallel to said longitudinal axis for locating said detent in first and second positions on opposite sides of said cantilever.

10. The switch as defined in claim 7, wherein said retaining member is fixed in said neck portion by at least one detent extending from said retaining member and engaging at least one tab defined in said neck portion.

11. The switch as defined in claim 10, wherein said retaining member includes a circular flange having a diameter generally equal to an end of said housing within said body for preventing a withdrawal of said end cap from said housing yet permitting pivotal movement of said end cap within said housing.

12. The switch as defined in claim 7, wherein said contact assembly includes:

a first contact strip having a first end disposed within said neck portion and a second end extending outwardly from said neck portion and positioned proximate a peripheral edge of said retaining member; and a conductive spring concentrically disposed within said neck portion and having a first end in contact with said first end of said contact strip, and a second end for engaging one pole of said battery.

13. The switch as defined in claim 7, wherein said end cap includes a grip for manually pivoting said switch between said positions.

14. A switch for selectively connecting and disconnecting a direct current circuit, comprising:

a housing having a cylindrical inner wall;

a detent extending from said inner wall;

an end cap having a neck portion concentrically received by said housing and extending substantially the length of said housing;

a cantilever spring disposed in a slot formed in said neck portion for defining first and second positions for said detent on opposite sides of said cantilever spring;

a contact assembly disposed within said neck portion and having a first end for contacting one end of the circuit and a second end for selectively contacting an opposite end of the circuit; and a retaining member disposed within said neck portion and fixed therein for preventing said neck portion from being withdrawn from said housing while allowing rotation of said end cap between said first and second positions.

15. The flashlight as defined in claim 1, wherein said switch assembly is detachable from said body for inserting said power source therein.

16. The switch as defined in claim 12, further comprising:

a second contact strip extending generally the length of said housing interior and having a first end in electrical contact with the light source and a second end disposed proximate said second end of said first contact strip;

said first contact strip selectively contacting said second contact strip in a wiping action with said end cap pivoted between said positions.

17. A flashlight, comprising:

a body for receiving a power source therein;

a light assembly including a light source coupled to said body, said light source having one terminal positioned to be in electrical contact with one pole of said power source and a second terminal positioned to be proximate an opposite pole of said power source;

a switch assembly closing said body, for selectively connecting and disconnecting said light source with said opposite pole of said power source, said switch assembly having a housing having a first end detachably received in said body and an end cap received in and closing said housing, said end cap being rotatable about an axis between a first position electrically connecting said light source and said power source, and a second position electrically disconnecting said light source and said power source;

a contact assembly disposed in said end cap for contacting said opposite end of said battery;

a retaining member disposed within an end of said end cap inside said body for retaining said end cap within said housing;

a contract strip extending from said light assembly substantially the length of said housing and selectively in contact with said contact assembly disposed in said end cap; and a hydrogen absorbing device disposed in said end cap.

18. A flashlight, comprising:

a body for receiving a power source therein;

a light assembly including a light source coupled to said body, said light source having one terminal positioned to be in electrical contact with one pole of said power source and a second terminal positioned to be proximate an opposite pole of said power source;

a switch assembly closing said body, for selectively connecting and disconnecting said light source with said opposite pole of said power source and having a housing having a first end detachably received in said body and an end cap received in and closing said housing, said end cap being rotatable about an axis coincident with said housing between a first position electrically connecting said light source and said power source, and a second position electrically disconnecting said light source and said power source;

a contact assembly disposed in said end cap for contacting said opposite end of said battery;

a retaining member disposed within said end cap for retaining said end cap within said housing;

a key received in said end cap;

a flange defined at one end of said key to lie adjacent said end cap and said housing; and a locking detent formed on said key for engaging said end cap, locking said flange adjacent said end cap and said housing.

19. A switch for selectively placing a light source in electrical communication with at least one battery disposed in a body, comprising:

a housing detachably adapted to be coupled to said body, and having a detent extending from an inner surface thereof;

an end cap having a neck portion concentrically received in said housing, said neck portion having a groove for receiving said detent to define at least a first and second position;

a contact assembly disposed in said neck portion and having a first portion in electrical communication with the battery and a second portion forming a contact;

a retaining member received in said neck portion for fixing said contact assembly within said neck portion and pivotally retaining said neck portion within said housing fixed with respect to said body;

a key slot defined in and extending through a wall of said neck portion;

a spline extending from said retaining member to be received in said key slot for orienting said retaining member in said neck portion and urging in a portion of said contact assembly toward a periphery of said neck portion; and said end cap being manually pivotal with respect to said housing between said positions for selectively moving said contact into electrical communication with the light source.

* * * * *